US008719967B2

(12) United States Patent
Milsom

(10) Patent No.: US 8,719,967 B2
(45) Date of Patent: May 13, 2014

(54) HELMET

(75) Inventor: Tom Milsom, Bristol (GB)

(73) Assignee: Ayrtek (TM) Limited, Brislington, Bristol (GB)

( * ) Notice: Subject to any disclaimer, the term of this patent is extended or adjusted under 35 U.S.C. 154(b) by 486 days.

(21) Appl. No.: 13/125,326

(22) PCT Filed: Jan. 19, 2009

(86) PCT No.: PCT/GB2009/000138

§ 371 (c)(1),
(2), (4) Date: Apr. 21, 2011

(87) PCT Pub. No.: WO2009/090410

PCT Pub. Date: Jul. 23, 2009

(65) Prior Publication Data

US 2011/0271427 A1 Nov. 10, 2011

(30) Foreign Application Priority Data

Jan. 18, 2008 (GB) ..... 0800971.4

(51) Int. Cl.

| | |
|---|---|
| ***A42B 3/00*** | (2006.01) |
| ***A42B 3/12*** | (2006.01) |
| *A63B 71/10* | (2006.01) |

(52) U.S. Cl.

CPC ..... *A42B 3/125* (2013.01); *A42B 3/128* (2013.01)

USPC ..... 2/413; 2/425; 2/411

(58) Field of Classification Search

CPC ..... A42B 3/125; A42B 3/128; A42B 3/06; A42B 3/063; A42B 3/069; A42B 3/12; A42B 3/121

USPC ..... 2/410–414, 417–419, 425, DIG. 3

See application file for complete search history.

(56) References Cited

U.S. PATENT DOCUMENTS

| | | | | |
|---|---|---|---|---|
| 2,618,780 | A | 11/1952 | Crushman | |
| 3,609,764 | A | 10/1971 | Morgan | |
| 3,668,704 | A | 6/1972 | Conroy | |
| 3,866,243 | A | 2/1975 | Morgan | |
| 3,994,022 | A | 11/1976 | Villari | |
| 4,014,048 | A | 3/1977 | Rappleyea | |
| 4,035,846 | A | 7/1977 | Jencks | |
| 4,114,197 | A * | 9/1978 | Morton | 2/423 |
| 4,287,613 | A * | 9/1981 | Schulz | 2/413 |
| 4,566,137 | A | 1/1986 | Gooding | |

(Continued)

FOREIGN PATENT DOCUMENTS

| | | |
|---|---|---|
| CN | 1230377 | 10/1999 |
| DE | 7729063 | 12/1977 |

(Continued)

*Primary Examiner* — Gloria Hale
(74) *Attorney, Agent, or Firm* — Clark & Brody

(57) ABSTRACT

A helmet, especially a cricket or other sports helmet, comprises an outer shell member and, disposed adjacent its inner surface, a layer comprising an inflatable element operatively connected with inflation mechanism. The layer comprising the inflatable element preferably comprises a plurality of individual cells or pockets defined by a fluid-impermeable plastics membrane material, the individual cells or pockets being mutually in communication for pressurization and pressure-release purposes and connected to the inflation mechanism. The cells or pockets may contain impact-absorption or cushioning materials which are preferably porous to allow absorption and desorption of the inflation fluid.

9 Claims, 2 Drawing Sheets

(56) References Cited

U.S. PATENT DOCUMENTS

| | | | | |
|---|---|---|---|---|
| 4,586,200 | A | 5/1986 | Poon | |
| 5,083,320 | A | 1/1992 | Halstead | |
| 5,175,889 | A | 1/1993 | Infusino | |
| 5,263,203 | A | 11/1993 | Kraemer et al. | |
| 5,846,063 | A | 12/1998 | Lakic | |
| 5,913,412 | A | 6/1999 | Huber | |
| 6,073,271 | A * | 6/2000 | Alexander et al. | 2/413 |
| 6,226,801 | B1 * | 5/2001 | Alexander et al. | 2/413 |
| 6,282,724 | B1 * | 9/2001 | Abraham et al. | 2/412 |
| 6,446,270 | B1 * | 9/2002 | Durr | 2/412 |
| 6,530,092 | B2 | 3/2003 | Pope | |
| 6,591,428 | B2 | 7/2003 | Halstead | |
| 6,681,408 | B2 * | 1/2004 | Ku | 2/413 |
| 6,817,039 | B1 * | 11/2004 | Grilliot et al. | 2/413 |
| 2003/0140401 | A1 | 7/2003 | Ku | |
| 2003/0200598 | A1 | 10/2003 | Jessie | |

FOREIGN PATENT DOCUMENTS

| | | |
|---|---|---|
| DE | 19938497 | 4/2000 |
| EP | 1316264 | 6/2003 |
| GB | 824682 | 12/1959 |
| GB | 1591265 | 6/1981 |
| GB | 2 404 328 | 2/2005 |
| JP | 4-194005 | 7/1992 |
| JP | 7-166406 | 6/1995 |
| WO | 2007/114720 | 10/2007 |

* cited by examiner

HELMET

FIELD OF THE INVENTION

This invention relates to helmets and, particularly but not exclusively, provides sports helmets suitable for use in protection of the wearer from adverse consequences of impacts with an object such as, for example, a cricket ball.

BACKGROUND ART

It is nowadays, in many jurisdictions, mandatory for sports people participating in certain sports, including cricket, to wear suitable head protection. In the case of cricket, for example, such head protection comprises a helmet having an essentially rigid outer shell, intended to spread or dissipate forces associated with impact by an airborne cricket ball to prevent injury especially to the wearer's head above the level of the ears and eyes, and usually a faceguard to protect the face and ears. However, there have been isolated incidents in which injury to the head or face has been sustained by virtue of secondary impact, following primary impact between the helmet or faceguard and the ball, between the helmet and the head or face of the user. There is, therefore, a need to provide improved helmets in which the possibility of injury being sustained through the agency of the helmet itself is minimized, while at the same time keeping the weight and size of the helmet to a minimum. In other sports or pastimes, including for example field hockey, ice hockey, lacrosse and cycling and irrespective of legislation relating to the use of helmets, their use may be recommended as a matter of common sense. Risks may occur not just with possible impact with an airborne ball or other object but also where the wearer may suffer a fall or some other event resulting in a head impact, and the availability of a helmet which dissipated impact forces while being comfortable to wear would clearly be advantageous.

SUMMARY OF THE INVENTION

In one aspect, according to the present invention, a helmet comprises an outer shell member and, disposed adjacent its inner surface, a layer comprising an inflatable element operatively connected with inflation means.

In helmets according to the invention, the inflation means allows the inflatable element to be inflated and, thus, volumetrically expanded after the helmet has been placed on the wearer's head and includes a pressure relief valve to facilitate removal of the helmet from the head by allowing the internal pressure within the inflatable element to be released. The layer comprising the inflatable element may directly adjoin the inner surface of the shell and may be removable therefrom, whereby the layer may be made and sold separately from the shell of the helmet.

Inflation of the inflatable element may be by means of any convenient fluid although a gaseous medium is preferred, air being a convenient example. The inflation means may comprise a source of inflation fluid, compressed and connected to the element by suitable valve means, or a pump which supplies the inflation fluid at super-atmospheric pressure.

The layer comprising the inflatable element preferably comprises a plurality of individual cells or pockets defined by a fluid-impermeable plastics membrane material, the individual cells or pockets being mutually in communication for pressurization and pressure-release purposes and connected to the inflation means. The cells or pockets may contain impact-absorption or cushioning materials which are preferably porous to allow absorption and desorption of the inflation fluid.

In one embodiment, the impact-absorption or cushioning material comprises, as separate elements in combination, a high-density plastics foam layer formed for example from expanded polystyrene, polyurethane or other impact-absorbing material and one or more relatively low-density foam layers disposed adjacent each other. The low-density foam layer may be formed from polystyrene or expanded polyalkylene such as polypropylene. The high-density material is intended to absorb the initial impact of the helmet with a ball or other object and will dissipate the impact force. The low-density foam layer is preferably disposed underlying the high-density material, which is disposed beneath the helmet shell. The combination of high-density and low-density layers in such an arrangement provides exceptional protection as measured in terms of deceleration of a simulated cricket ball on impact with the shell of the helmet. It also provides improved comfort for the wearer, compared with current commercially-available helmets, with less risk of injury being caused by the helmet itself following, for example, impact with a ball or in the event of a fall.

Preferably, the high-density plastics material has a density in the range of 200-300 kg/m$^3$, whereas the low-density material has a density in the range 20-50 kg/m$^3$. Typically, the high-density material has a thickness of 2-5 mm and the low-density material has a thickness of 7-12 mm.

Preferably, the fluid-impervious material is provided, on its outer surface facing towards the wearer's head, in use, with a layer of towelling or other absorption material to absorb sweat.

The inflation means is preferably either connected to or disposed on the helmet liner at a position corresponding with the back of the neck, when the helmet is being worn in the normal way in use. Conveniently, the inflation means comprises a manually-operable pump acting through a non-return valve and including a pressure release valve for deflation purposes.

BRIEF DESCRIPTION OF THE DRAWINGS

Embodiments of the invention will now be described by way of example with reference to the accompanying drawings, of which.

DETAILED DESCRIPTION OF THE INVENTION

Figure 1:
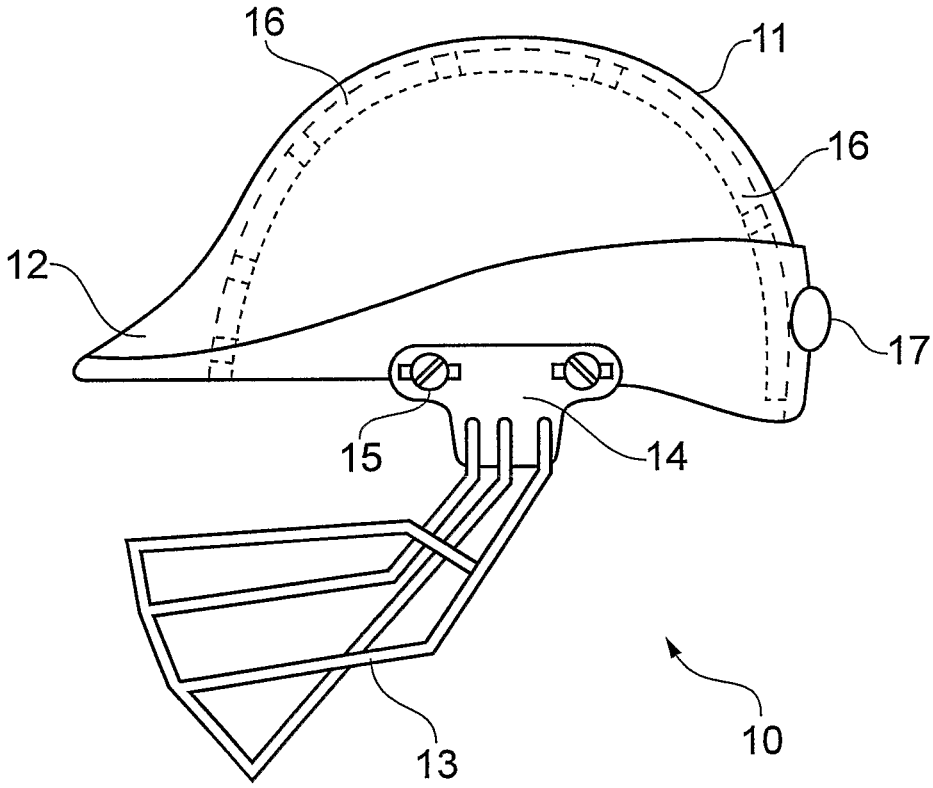
FIG. 1 is a side elevation of a cricket helmet according to the invention.

Referring firstly to FIG. 1, the cricket helmet, shown generally at 10, has an outer shell 11 with, at the front, a peak 12. A face and chin guard assembly 13 is attached to the sides of the helmet via a support plate 14 and manually-operable retaining bolts 15.

The inner surface of the shell 11 carries an inflatable liner or air bladder comprising individual cells or pockets 16 which are in pneumatic communication with each other and with a manually-operable air pump operated by a resilient push button 17 disposed at the rear of the shell. A button for a pressure release valve (not shown) is also disposed at the rear of the shell. The pockets 16 are formed from a pre-cut polyurethane sheet material of thickness 1 mm having an embossed surface finish and are vacuum-formed and high frequency welded to a pre-cut polyurethane sheet carrier. Before the pockets are formed, a layer of a high-density polyurethane foam having a density 272 kg/m$^3$ and a thickness of 3 mm is laminated to a layer of low-density polypropylene foam having a density of 30 kg/m$^3$ and a thickness of 10 mm. The laminate is stamped or otherwise cut to form individual shapes corresponding with the respective pockets to be formed and are placed in position on the backing sheet before the cover sheet is molded and welded to the backing sheet, thus loosely encapsulating the laminate shapes so that, when the bladder is inflated the foam laminates are moveable or displaceable within the individual pockets, to ensure a comfortable fit on the wearer's head. The high-density polyurethane foam is disposed adjacent the inner wall of the helmet shell and the low-density polypropylene foam is disposed adjacent the wearer's head, in use. A layer of towelling material (not shown) is disposed over the inflatable liner, for comfort and absorption of sweat.

Figure 2:
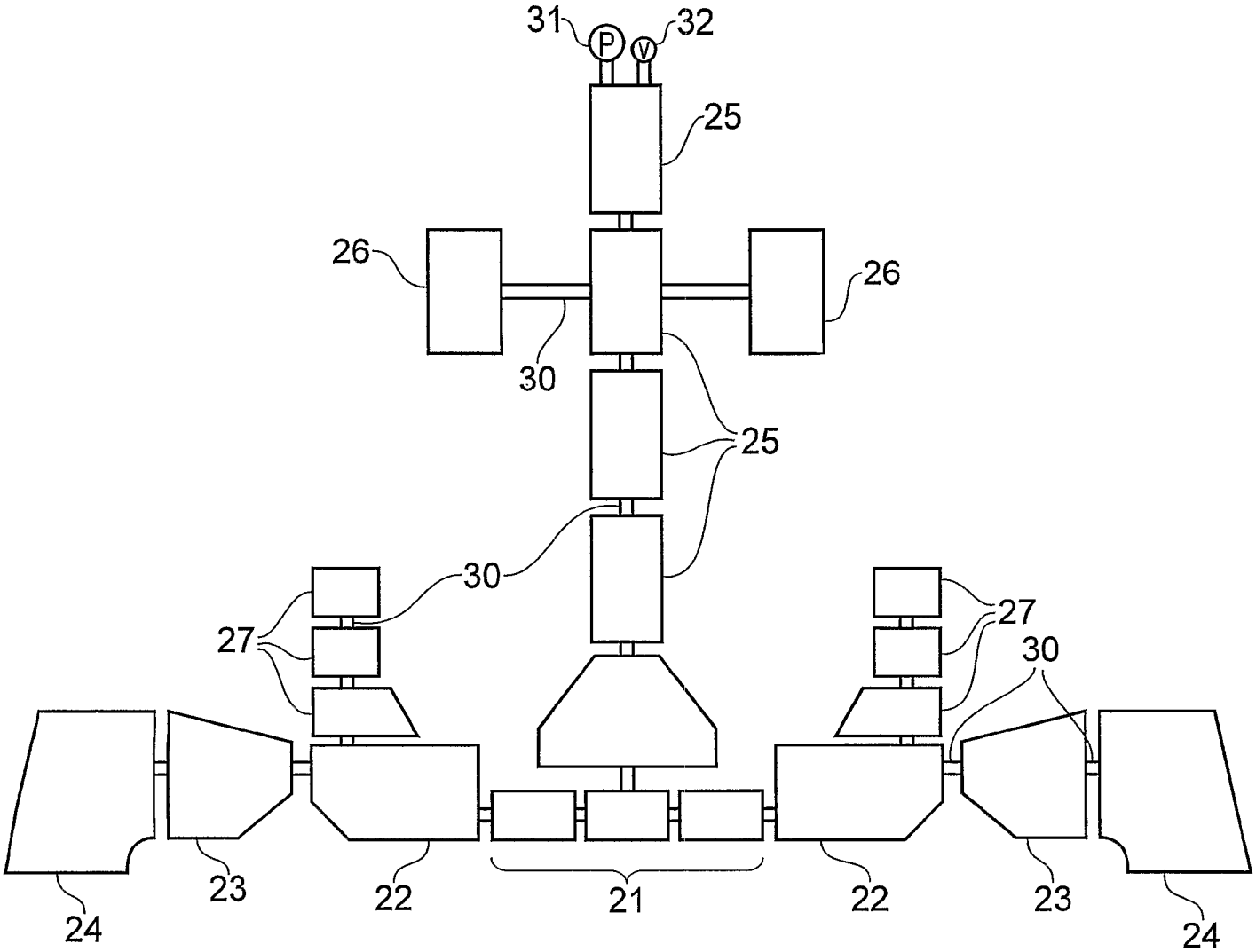
FIG. 2 is an illustration showing the arrangement of the various inflatable elements constituting the liner of the cricket helmet shown in FIG. 1.

With reference to FIG. 2, the pockets are shown as they would be formed, on a flat surface. Having been formed, they are then placed within the helmet shell in such a way that pockets 21 lie adjacent the forehead, in use; pockets 22 and 23 lie respectively in front of and behind the ears; pockets 24 are at the rear of the skull and pockets 25 extend over the crown to the back of the head. Pockets 26 and 27 protect the upper part of the sides of the skull. The pockets are mutually in communication via conduits 30 formed from the polyurethane backing and cover sheet as the liner is manufactured and the end pocket 25 is in communication with the air pump 31 and pressure release valve 32.

Cricket helmets as described with reference to the drawings, with the helmet shell being formed respectively from traditional fibre glass and carbon fibre, were subject to impact attenuation tests according to the test protocol as set out in British Standard BS7928:1998. For comparison purposes, commercially-available Albion and Mazurai helmets were subject to similar tests. In order to pass the test, the British Standard requires that the maximum deceleration of the striker shall not exceed 250 $g_n$, where the symbol $g_n$ signifies a deceleration of 9.81 m/s$^2$. It was found that, whereas all helmets passed the test under the above criterion, with the commercially-available helmets recording deceleration values of between 46 and 64 for a first impact and 53 and 137 for a second impact, depending on the zone of the shell being tested (right side, left side, front and so on), the helmets according to the invention consistently recorded deceleration figures less than 20 for both first and second impacts, this being the lower limit perception threshold of the test equipment.

In use, helmets according to the invention are initially deflated by depressing the pressure release valve and are then placed on the head and secured with the chin strap (not shown) either against or underneath the chin, in known manner. The liner is then inflated manually by depressing on the inflation button at the rear of the helmet until the helmet is felt to fit firmly on the head without wobbling. The inflation pressure can be adjusted at will either by operating the pressure release button or by operating the inflation pump to achieve a higher pressure.

The invention claimed is:

1. A helmet comprising an outer shell member and, disposed adjacent an inner surface of the outer shell member, a layer comprising an inflatable element operatively connected with inflation means, in which the layer comprising the inflatable element comprises a plurality of individual pockets defined by a fluid-impermeable plastics membrane material, the individual pockets being mutually in communication for pressurization and pressure-release purposes and connected to the inflation means, characterized in that the pockets contain impact-absorption or cushioning materials comprising, as separate elements in combination, a high-density plastics impact-absorbing foam layer and a relatively low-density foam layer, wherein the high-density plastics material has a density in the range of 200-300 kg/m3 and wherein the low-density material has a density in the range of 20-50 kg/m3.

2. A helmet according to claim 1, in which the inflation means includes a pressure relief valve.

3. A helmet according to claim 1, in which the inflation means comprises a pump which supplies inflation fluid at a higher pressure than atmospheric pressure.

4. A helmet according to claim 1, in which the low-density foam layer is disposed underlying the high-density material, the high-density material being disposed beneath the helmet shell.

5. A helmet according to claim 1, in which the inflation means is disposed on the layer at a position corresponding with a back of a user's neck and comprises a manually-operable pump acting through a non-return valve and including a pressure release valve for deflation purposes.

6. A layer for use with a helmet comprising an inflatable element operatively connected with inflation means, in which the inflatable element further comprises a plurality of individual pockets defined by a fluid-impermeable plastics membrane material, the individual pockets being mutually in communication for pressurization and pressure-release purposes and connected to the inflation means, characterized in that the pockets contain impact-absorption or cushioning materials comprising, as separate elements in combination, a high-density plastics impact-absorbing foam layer and a relatively low-density foam layer, wherein the high-density plastics material has a density in the range of 200-300 kg/m3 and wherein the low-density material has a density in the range of 20-50 kg/m3.

7. A helmet according to claim 2, in which the low-density foam layer is disposed underlying the high-density material, the high-density material being disposed beneath the helmet shell.

8. A helmet according to claim 3, in which the low-density foam layer is disposed underlying the high-density material, the high-density material being disposed beneath the helmet shell.

9. The layer according to claim 6, wherein the low-density foam layer is disposed underlying the high-density material.

* * * * *